US006475302B2

(12) United States Patent
Mei et al.

(10) Patent No.: US 6,475,302 B2
(45) Date of Patent: Nov. 5, 2002

(54) PERMANENT MAGNET

(75) Inventors: Wu Mei; Toshiya Sakamoto, both of Yokohama; Shinya Sakurada, Tokyo; Takao Sawa, Yokohama; Akihiko Tsutai; Akiko Saito, both of Kawasaki; Masashi Sahashi, Yokohama, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 7 days.

(21) Appl. No.: 09/749,803

(22) Filed: Dec. 28, 2000

(65) Prior Publication Data

US 2001/0020495 A1 Sep. 13, 2001

(30) Foreign Application Priority Data

Dec. 28, 1999 (JP) ..... 11-375478

(51) Int. Cl.[7] ..... H01F 1/055
(52) U.S. Cl. ..... 148/303; 148/301
(58) Field of Search ..... 148/301, 302, 148/303

(56) References Cited

U.S. PATENT DOCUMENTS 5,480,495 A 1/1996 Sakurada et al.
5,800,728 A * 9/1998 Iwata ..... 252/62.53

FOREIGN PATENT DOCUMENTS

| | | | |
|---|---|---|---|
| JP | 60-144909 | | 7/1985 |
| JP | 60-254707 | | 12/1985 |
| JP | 64-067902 | | 3/1989 |
| JP | 5-226123 | | 9/1993 |
| JP | 6-283316 | A * | 10/1994 |
| JP | 2000-114016 | | 4/2000 |
| JP | 2000-114017 | | 4/2000 |

* cited by examiner

*Primary Examiner*—John Sheehan
(74) *Attorney, Agent, or Firm*—Oblon, Spivak, McClelland, Maier & Neustadt, P.C.

(57) ABSTRACT

Disclosed is a permanent magnet which comprises an alloy containing a hard magnetic phase having a ThMn12 type tetragonal structure and a nonmagnetic phase. The alloy is represented by a general formula given below:

$$[R_{1-a}(M1)_a][T_{1-b-c}(M2)_b(M3)_c]_d X_\alpha$$

where R is at least one rare earth element (including Y), Ml is at least one element selected from the group consisting of Zr and Hf, T is at least one element selected from the group consisting of Fe, Co and Ni, M2 is at least one element selected from the group consisting of Cu, Bi, Sn, Mg, In and Pb, M3 is at least one element selected from the group consisting of Al, Ga, Ge, Zn, B, P and S, X is at least one element selected from the group consisting of Si, Ti, V, Cr, Mn, Nb, Mo, Ta and W, and the atomic ratios of a, b, c, d and $\alpha$ fall within the ranges of $0 \leqq a \leqq 0.6$, $0.01 \leqq b \leqq 0.20$, $0 \leqq c \leqq 0.05$, $6 \leqq d \leqq 11$, and $0.5 \leqq \alpha \leqq 2.0$.

15 Claims, No Drawings

PERMANENT MAGNET

CROSS-REFERENCE TO RELATED APPLICATIONS

This application is based upon and claims the benefit of priority from the prior Japanese Patent Application No. 11-375478, filed Dec. 28, 1999, the entire contents of which are incorporated herein by reference.

BACKGROUND OF THE INVENTION

The present invention relates to a permanent magnet, particularly, to a permanent magnet excellent in saturation magnetization and coercive force and having improved temperature characteristics of the coercive force.

A Sm—Co magnet, a Nd—Fe—B magnet, etc. are known as a high performance permanent magnet. These conventional permanent magnets are widely used in various motors such as VCM and a spindle motor, a measuring instrument, a loud speaker, MRI for medical treatment, and in key parts in various electrical appliances.

Each of these conventional permanent magnets contains a large amount of Fe or Co and a small amount of a rare earth element. Fe or Co contributes to the increase in the saturation magnetic flux density. On the other hand, the rare earth element brings about a very large magnetic anisotropy derived from the behavior of 4 f electrons in the crystalline field so as to contribute to the increase in the coercive force and, thus, realize good magnetic characteristics.

In recent years, demands for miniaturization of various electrical appliances and for energy saving are on a sharp increase. In this connection, further improvement in the maximum energy product [(BH)max] and in the temperature characteristics are required for the permanent magnet used as a material of a key part of these electrical appliances.

Under the circumstances, new magnet materials are being studied from various angles. For example, Japanese Patent Disclosure (Kokai) No. 60-144909 and Japanese Patent Disclosure No. 60-254707 disclose a permanent magnet represented by a general formula $R_{1-\alpha-\beta-\gamma}Fe_{\alpha}M_{\beta}X_{\gamma}$, where R is at least one rare earth element (including Y); M is at least one element selected from the group consisting of Ti, Zr, Hf, V, Nb, Ta, Cr, Mo and W; X is at least one element selected from the group consisting of B, C, N, Si and P; and $\alpha$, $\beta$, $\gamma$ fall within the ranges of: $0.6 \leqq \alpha \leqq 0.85$; $0.01 \leqq \beta \leqq 0.1$; $\gamma < 0.15$; and a method of manufacturing the particular permanent magnet.

On the other hand, Japanese Patent Disclosure No. 64-67902 and Japanese Patent Disclosure No. 5-226123 propose a magnetic material having a ThMn12 type crystal structure represented by R-Ti-Fe (R representing a rare earth element) and R1-R2-Si-M-T (R1 representing Zr or Hf; R2 representing a rare earth element; M representing C, N or P; and T representing Fe or Co).

Further, a magnetic material prepared by introducing N or C into an intermetallic compound based on $Sm_2Fe_{17}$ exhibits an elevated Curie temperature and an improved magnetic anisotropy and, thus, attracts attentions as a novel magnetic material. However, this magnetic material leaves room for further improvement in the thermal stability. Specifically, this magnetic material is decomposed into a rare earth nitride or carbide and Fe at temperatures around 500° C., making it difficult to realize a sintered magnet. Also, further improvement in the magnetic characteristics is required. Particularly required are a high saturation magnetization and a high coercive force.

As described above, it is of high importance to develop a permanent magnet exhibiting a higher coercive force and a higher saturation magnetization (higher residual magnetization) in accordance with miniaturization and high efficiency of the electrical appliance and electronic equipment. Particularly, it is required to achieve a high coercive force and a high saturation magnetization (high residual magnetization) under the environmental temperature of using such an electrical appliance and electronic equipment.

It should be noted that an NbFeB magnet is poor in the temperature characteristics of the coercive force and, thus, the temperature range within which the magnet is used is limited. On the other hand, the sintered magnetic material or sintered magnet disclosed in, for example, Japanese Patent Disclosure No. 60-144906, which certainly exhibits a high coercive force of about 10 kOe, exhibits a relatively low residual magnetic flux density of about 12 kG and, thus, fails to exhibit sufficient characteristics of a magnet.

The SmFe alloy system in which TbCu7 phase can be obtained remains to be no more than utilization of what is obtained by the method of creating a so-called "non-equilibrium phase" such as the liquid rapid cooling method or the mechanical alloying method. Therefore, where an element such as N or C is introduced into the position between lattices, the thermal stability was not sufficient, though it may be possible to obtain relatively excellent magnetic characteristics.

On the other hand, the magnetic material having a ThMn12 type crystal structure, which is known to the art, includes materials of three element system such as $SmFe_{10}Si_2$, $SmFe_{10}Mo_2$, $SmFe_{10}V_2$, $SmFe_{10}Cr_2$, $SmFe_{10}W_2$ and $SmFe_{11}Ti_1$. Each of these materials has a small coercive force and has not yet been put to a practical use as a permanent magnet.

In the alloy systems described above, a nonmagnetic element is substituted in a large amount in order to stabilize the ThMn12 phase, leading to a low saturation magnetization. Also, since a microstructure of (ferromagnetic phase+nonmagnetic phase) as in the NbFeB magnet is not formed, a sufficient coercive force is not obtained.

BRIEF SUMMARY OF THE INVENTION

An object of the present invention is to provide a permanent magnet excellent in saturation magnetization and coercive force and having improved temperature characteristics of the coercive force.

According to a first aspect of the present invention, there is provided a permanent magnet which comprises an alloy containing a hard magnetic phase having a ThMn12 type tetragonal structure and a nonmagnetic phase.

According to a second aspect of the present invention, there is provided a permanent magnet which comprises an alloy containing a hard magnetic phase having a ThMn12 type tetragonal structure and a nonmagnetic phase, wherein the alloy is represented by a general formula given below:

$$[R_{1-a}(M1)_a][T_{1-b-c}(M2)_b(M3)_c]_d X_\alpha$$

where R is at least one rare earth element (including Y); M1 is at least one element selected from the group consisting of Zr and Hf; T is at least one element selected from the group consisting of Fe, Co and Ni; M2 is at least one element selected from the group consisting of Cu, Bi, Sn, Mg, In and Pb; M3 is at least one element selected from the group consisting of Al, Ga, Ge, Zn, B, P and S; X is at least one element selected from the group consisting of Si, Ti, V, Cr, Mn, Nb, Mo, Ta and W; and the atomic ratios of a, b, c, d and $\alpha$ fall within the ranges of: $0 \leqq a \leqq 0.6$; $0.01 \leqq b \leqq 0.20$; $0 \leqq c \leqq 0.05$; $6 \leqq d \leqq 11$; and $0.5 \leqq \alpha \leqq 2.0$.

According to a third aspect of the present invention, there is provided a permanent magnet which comprises an alloy containing a hard magnetic phase having a ThMn12 type tetragonal structure and a nonmagnetic phase, wherein the alloy is represented by a general formula given below:

$$[R_{1-a}(M1)_a][T_{1-b-c}(M2)_b(M3)_c]_d X_\alpha A_\beta$$

where R is at least one rare earth element (including Y); M1 is at least one element selected from the group consisting of Zr and Hf; T is at least one element selected from the group consisting of Fe, Co and Ni; M2 is at least one element selected from the group consisting of Cu, Bi, Sn, Mg, In and Pb; M3 is at least one element selected from the group consisting of Al, Ga, Ge, Zn, B, P and S; X is at least one element selected from the group consisting of Si, Ti, V, Cr, Mn, Nb, Mo, Ta and W; A is at least one element selected from the group consisting of N, C and H; and the atomic ratios of a, b, c, d and $\alpha$ fall within the ranges of: $0 \leqq a \leqq 0.6$; $0.01 \leqq b \leqq 0.20$; $0 \leqq c \leqq 0.05$; $6 \leqq d \leqq 11$; $0.5 \leqq \alpha \leqq 2.0$; and $0 < \beta < \leqq 2.0$.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

As a result of an extensive research conducted in view of the above-noted problems inherent in the prior art, the present inventors have found that an alloy microstructure comprising at least two phases including a principal phase of ThMn12 phase and a nonmagnetic phase can be obtained by adding a specified element to the intermetallic compound consisting mainly of a rare earth element-Fe. It has been found that this particular alloy microstructure permits obtaining a high coercive force. Particularly, it has been found that, if the rare earth element is partly replaced by a predetermined element such as Zr, it is possible to decrease the addition amount of the element added for stabilizing the principal phase of the ThMn12 phase so as to improve the saturation magnetic flux density and the residual magnetic flux density. It has also been found that a high coercive force and excellent temperature characteristics can be obtained so as to provide a permanent magnet having a high maximum energy product.

To be more specific, the present invention provides a permanent magnet which comprises an alloy having a hard magnetic phase having a ThMn12 tetragonal structure and a nonmagnetic phase.

The permanent magnet of the present invention comprises an alloy represented by general formula [I] given below:

$$[R_{1-a}(M1)_a][T_{1-b-c}(M2)_b(M3)_c]_d X_\alpha \quad [I]$$

where R is at least one rare earth element (including Y); M1 is at least one element selected from the group consisting of Zr and Hf; T is at least one element selected from the group consisting of Fe, Co and Ni; M2 is at least one element selected from the group consisting of Cu, Bi, Sn, Mg, In and Pb; M3 is at least one element selected from the group consisting of Al, Ga, Ge, Zn, B, P and S; X is at least one element selected from the group consisting of Si, Ti, V, Cr, Mn, Nb, Mo, Ta and W; and the atomic ratios of a, b, c, d and $\alpha$ fall within the ranges of: $0 \leqq a \leqq 0.6$; $0.01 \leqq b \leqq 0.20$; $0 \leqq c \leqq 0.05$; $6 \leqq d \leqq 11$; and $0.5 \leqq \alpha \leqq 2.0$.

It is also possible for the permanent magnet of the present invention to be formed of an alloy represented by general formula [II] given below:

$$[R_{1-a}(M1)_a][T_{1-b-c}(M2)_b(M3)_c]_d X_\alpha A_\beta \quad [II]$$

where R is at least one rare earth element (including Y); M1 is at least one element selected from the group consisting of Zr and Hf; T is at least one element selected from the group consisting of Fe, Co and Ni; M2 is at least one element selected from the group consisting of Cu, Bi, Sn, Mg, In and Pb; M3 is at least one element selected from the group consisting of Al, Ga, Ge, Zn, B, P and S; X is at least one element selected from the group consisting of Si, Ti, V, Cr, Mn, Nb, Mo, Ta and W; A is at least one element selected from the group consisting of N, C and H; and the atomic ratios of a, b, c, d, $\alpha$ and $\beta$ fall within the ranges of: $0 \leqq a \leqq 0.6$; $0.01 \leqq b \leqq 0.20$; $0 \leqq c \leqq 0.05$; $6 \leqq d \leqq 11$, $0.5 \leqq \alpha \leqq 2.0$; and $0 < \beta \leqq 2.0$.

In the permanent magnet of the present invention represented by general formula [I], the nonmagnetic phase can be represented by a general formula given below:

$$R_a M_b T_c X_d O_e$$

where R is at least one rare earth element (including Y); M is at least one element selected from the group consisting of Cu, Bi, Sn, Mg, Pd and In; T is at least one element selected from the group consisting of Si, Fe, Co, Ni, Mn, Al, Ga, Ge, Ti, Zr, Hf, Ta, V, Nb, Cr, Mo, W and Zn; X is at least one element selected from the group consisting of B, C, P and S; and the atomic ratios of a, b, c, d, e fall within the ranges of: $a+b+c+d+e=100$; $1 \leqq a \leqq 60$; $1 \leqq b \leqq 90$; $0 \leqq c \leqq 50$; $0 \leqq d \leqq 10$; $0 \leqq e \leqq 30$.

In the permanent magnet of the present invention represented by general formula [II], the nonmagnetic phase can be represented by a general formula given below:

$$R_a M_b T_c X_d O_e$$

where R is at least one rare earth element (including Y); M is at least one element selected from the group consisting of Cu, Bi, Sn, Mg, Pd and In; T is at least one element selected from the group consisting of Si, Fe, Co, Ni, Mn, Al, Ga, Ge, Ti, Zr, Hf, Ta, V, Nb, Cr, Mo, W and Zn; X is at least one element selected from the group consisting of B, C, P, S, C, N and H; and the atomic ratios of a, b, c, d, e fall within the ranges of: $a+b+c+d+e=100$; $1 \leqq a \leqq 60$; $1 \leqq b \leqq 90$; $0 < c \leqq 50$; $0 \leqq d \leqq 10$; $0 \leqq e \leqq 30$.

In the permanent magnet of the present invention, the principal phase represents the crystal phase having the largest volume occupying ratio among the crystal and amorphous phases constituting the permanent magnet alloy.

Preferred embodiments of the present invention will now be described.

The permanent magnet of the present invention comprises at least two phases including a ThMn12 phase obtained by adding a specified element such as Cu, Bi or Mg to an alloy system in which a body-centered tetragonal system of the ThMn12 phase can be obtained and another phase that is nonmagnetic under room temperature and has a melting point lower than that of the principal phase of the ThMn12 phase. It is desirable for the nonmagnetic phase to have a melting point lower by at least 50° C. than the melting point of the ThMn12 phase. It is possible for the single phase of the nonmagnetic phase to have a melting point lower than that of the ThMn12 phase. It is also possible for the melting point of the nonmagnetic phase to be lowered by the eutectic reaction of a plurality of phases.

In the permanent magnet of the present invention, a high coercive force can be obtained where the nonmagnetic phase having a melting point lower than that of the ThMn12 phase has preferably a volume ratio of 0.1 to 20%. If the nonmagnetic phase has a volume ratio smaller than 0.1%, it is difficult to obtain a high coercive force. On the other hand, if the volume ratio of the nonmagnetic phase exceeds 20%, the saturation magnetic flux density is lowered, leading to a low maximum energy product. It if more desirable for the volume ratio of the nonmagnetic phase to fall within a range of between 5% and 10%.

The volume ratio is determined by grasping the phase having a low melting point from the SEM evaluation, followed by obtaining an areal ratio by the image processing. The operation is performed for 10 planes, and the average value thereof is determined as the volume ratio. Incidentally, the composition can be determined by, for example, EDX.

As described previously, the permanent magnet of the present invention is represented by general formula [I] as described previously.

The function and amount of each component of the permanent magnet material represented by general formula [I] will now be described.

(1) Element R:

The element R produces a large magnetic anisotropy required for a permanent magnet and serves to contributes to the increase in the coercive force. The element R is selected from the group consisting of La, Ce, Pr, Nd, Sm, Eu, Gd, Tb, Dy, Ho, Er, Tm, Yb, Lu and Y. These elements can be used singly or in the form of a mixture of at least two of these elements. Particularly, Sm is desirable for use as the element R in view of the high crystalline magnetic anisotropy. It is desirable for Sm to constitute at least 50%, more preferably at least 75%, of the element R.

Also, in order to realize a high coercive force under high temperatures, it is desirable for the element R to contain at least one element selected from the group consisting of Gd, Dy, Er and Tb.

(2) Element M1:

The element M1 is selected from the group consisting of Zr and Hf. The element M1 is capable of substituting the site of the element R of the ThMn12 phase and is effective for increasing the saturation magnetic flux density of the permanent magnet.

The amount (a) of the element M1 should be not larger than 0.6. If the amount (a) exceeds 0.6, the magnetic anisotropy is lowered, leading to a low coercive force. The amount of the element M1 should fall preferably within a range of between 0.02 and 0.55, i.e., $0.02 \leqq a \leqq 0.55$, more preferably between 0.05 and 0.5, i.e., $0.05 \leqq a \leqq 0.5$.

(3) Element T:

The element T, which is selected from the group consisting of Fe, Co and Ni, is absolutely necessary for increasing the saturation magnetic flux density and for increasing the Curie temperature of the permanent magnet. Particularly, it is desirable for the element T to consist of Fe alone or to consist of a combination of FeCo. It is desirable for the substituting amount of Co for Fe to be up to 60%. If the Co substituting amount exceeds 60%, it is difficult to obtain a high magnetic anisotropy and a high saturation magnetic flux density. In the case of using Ni, it is desirable for the substituting amount of Ni for Fe to be not larger than 10%. If the Ni substituting amount exceeds 10%, the saturation magnetic flux density is lowered.

(4) Element M2:

The element M2 is selected from the group consisting of Cu, Ag, Bi, Mg, Sn, Pd and In. These elements are combined with the element R or the element T so as to precipitate a phase having a melting point lower than that of the principal phase and, preferably, being nonmagnetic so as to form at least two phase microstructure including a nonmagnetic phase having a low melting point and the principal phase. It is possible to realize a high coercive phase by utilizing the two phase microstructure.

If the amount (b) of the element M2 is smaller than 0.01, it is impossible to form the two phase microstructure, resulting in failure to contribute to the increase in the coercive force. On the other hand, if the amount (b) exceeds 0.20, the saturation magnetic flux density is lowered. Preferably, the amount (b) of the element M2 should fall within a range of between 0.01 and 0.15, i.e., $0.02 \leqq b \leqq 0.15$. It is desirable to use particularly Cu or Bi as the element M2.

In general, a phase having a low melting point on the phase diagram and formed of a nonmagnetic material is not observed in the sintered magnet or the like containing the ThMn12 phase as a principal phase. Therefore, it is impossible to prepare a magnetic material having a high coercive force by a method similar to the method of increasing the coercive force by utilizing a Nd-rich phase observed in, for example, the NdFeB magnet. According to the permanent magnet of the present invention, however, it is possible to obtain a magnetic material having a high coercive force by precipitating a alloy phase containing the elements R and M2 described above.

The alloy phase has a melting point lower than that of the principal phase and is considered to be preferably a nonmagnetic phase. Particularly, where the element M2 is Cu or Bi, the melting point of the nonmagnetic phase or the reaction temperature between the nonmagnetic phase and the principal phase is lower than the melting point of the principal phase. As a result, it is possible to carry out the sintering treatment or the hot working treatment even at a low temperature, making it possible to obtain a magnetic material having a high coercive force. Particularly, it is possible to obtain a high coercive force in the case where the sum of the elements R, M2 and T exceeds 50 atomic % of all the elements excluding oxygen in the alloy phase.

(5) Element 3:

The element M3 is effective for improving the magnetic characteristics. It is desirable for the amount (c) of the element M3 to be not larger than 0.05 because, if the amount (c) exceeds 0.05, the saturation magnetic flux density is lowered. The element M3 is selected from the group consisting of Al, Ga, Ge, Zn, B, P and S. It is particularly desirable to use B as the element M3. Incidentally, the sum (d) of the elements T, M2 and M3 should fall within a range of between 7 and 11 relative to the sum of the elements R and M1, i.e., $6 \leqq d \leqq 11$, in order to obtain a high coercive force and a large maximum energy product (BH)max. Preferably, the sum (d) should fall within a range of between 7.5 and 10.5, i.e., $7.5 \leqq d \leqq 10.5$.

(6) Element X:

The element X, which is selected from the group consisting of Si, Ti, V, Cr, Mn, Nb, Mo, Ta and W, contributes to the stabilization of the ThMn12 phase. The amount ($\alpha$) of the element X should fall within a range of between 0.5 and 2.0. If the amount ($\alpha$) is smaller than 0.5, it is difficult to form the ThMn12 phase. If the amount ($\alpha$) exceeds 2.0, however, the saturation magnetization is unduly lowered, resulting in failure to obtain a high maximum energy product (BH)max.

The method of the present invention for manufacturing a permanent magnet will now be described, with the sintering process taken up as an example.

In the first step, predetermined amounts of the elements R, M1, T, M2, X, etc. are mixed and melted by, for example, an arc melting method or a high frequency melting method so as to obtain an ingot. In this case, it is possible to prepare an alloy by a reducing method. The alloy thus prepared is subjected to a heat treatment at 800 to 1300° C. for 1 to 300 hours under vacuum or under an inert gas atmosphere, followed by a rapid cooling or a slow cooling. The cooling rate, which is not particularly limited in the present invention, may desirably be 20 to 500° C./hour. Though this heat treatment may be omitted, it is possible to obtain an uniform alloy microstructure by this heat treatment.

The resultant ingot is roughly pulverized by, for example, a jaw crusher, followed by finely pulverizing the ingot with, for example, a ball mill, a hammer mill or a jet mill to have an average particle diameter of about 2 to 20 $\mu$m. Incidentally, the resultant powder is left to stand for 1 to 1000 hours under an atmosphere having an oxygen partial pressure of 0.01 to 10 kPa so as to make it possible to obtain a larger coercive force. In this case, it is desirable for the gases other than the oxygen gas contained in the atmosphere to be inert gases, preferably Ar and He.

The powder obtained by the fine pulverization is pressed under a magnetic field so as to obtain a compressed powdery material. The compressed powdery material thus obtained is sintered under vacuum or under an inert gas atmosphere such as Ar at 1000 to 1300° C. for 0.1 to 10 hours. The resultant sintered body is subjected to a heat treatment, as required, under temperatures not higher than the sintering temperature and not lower than 300° C. for 0.1 to 200 hours. This heat treatment, which can be omitted, makes it possible to obtain a high coercive force.

The method of the present invention for manufacturing a permanent magnet is not limited to the method described above. For example, the alloy can be prepared by the ordinary melting method. Alternatively, a similar ThMn12 type crystal structure can be obtained by ejecting a molten alloy onto a moving cooling body. This method, which includes, for example, a single roll method, a twin roll method, and strip cast method, is not particularly limited.

In this case, the manufacturing conditions are not particularly limited, though it is desirable for the peripheral speed of the roll to be set at 0.1 to 20 m/sec and it is desirable to manufacture the permanent magnet under an inert gas atmosphere such as an Ar gas atmosphere or a He gas atmosphere. Any of a Cu-based alloy and a Fe-based alloy can be used as the roll material. Particularly, it is desirable to use a Cu-based alloy having a high hardness such as TiCu, BeCu or CrCu in view of the cooling capability.

The resultant sample is flake-like or thin band-like and has a thickness of 50 $\mu$m to 1 mm, preferably 70 $\mu$m to 0.8 mm, and more preferably 100 to 500 $\mu$m.

The permanent magnet of the present invention is also represented by formula [II] as described previously.

Formula [II] described above is equal to formula [I] given previously in R, M1, T, M2, M3, X, a, b, c, d, and $\alpha$ and, thus, the description thereof is omitted. It should be noted, however, that the preferred element R is Nd. It is desirable for Nd to be contained in an amount of at least 50%, preferably at least 75%, of the element R.

In the alloy represented by general formula [II], the element A, which is selected from the group consisting of N, C and H, enters mainly the position between lattices of the principal phase of the ThMn12 phase so as to improve the magnetic anisotropy and to improve the Curie temperature. The amount ($\beta$) of the element A falls within a range of between 0 and 2.0, i.e., $0<\beta\leqq 2.0$. If the amount ($\beta$) exceeds 2.0, $\alpha$-Fe is formed so as to bring about deterioration of the magnetic characteristics.

It is possible for the magnet of the present invention to contain compounds such as oxides, nitrides and carbides, which are based on the element X.

The method of manufacturing the permanent magnet represented by general formula [II] is substantially equal to the method of manufacturing the permanent magnet represented by general formula [I], except that the sintered body is subjected to a heat treatment under an atmosphere of a nitrogen gas, an ammonia gas, a hydrogen gas, a hydrocarbon gas such as a methane gas or an ethane gas or a mixture of these gases in the method of manufacturing the permanent magnet represented by general formula [II].

In the alloy represented by general formula [I], the nonmagnetic phase can be represented by the general formula given below:

$$R_aM_bT_cX_dO_e$$

where R is at least one rare earth element (including Y); M is at least one element selected from the group consisting of Cu, Bi, Sn, Mg, Pd and In; T is at least one element selected from the group consisting of Si, Fe, Co, Ni, Mn, Al, Ga, Ge, Ti, Zr, Hf, Ta, V, Nb, Cr, Mo, W and Zn; X is at least one element selected from the group consisting of B, C, P and S; and the atomic ratios of a, b, c, d, e fall within the ranges of: $a+b+c+d+e=100$; $1\leqq a\leqq 60$; $1\leqq b\leqq 90$; $0<c\leqq 50$; $0\leqq d\leqq 10$; $0\leqq e\leqq 30$.

In the above general formula, it is preferred that M is Cu, and b falls within the range of 30 to 90.

Also, in the alloy represented by general formula [II], the nonmagnetic phase can be represented by a general formula given below:

$$R_aM_bT_cX_dO_e$$

where R is at least one rare earth element (including Y); M is at least one element selected from the group consisting of Cu, Bi, Sn, Mg, Pd and In; T is at least one element selected from the group consisting of Si, Fe, Co, Ni, Mn, Al, Ga, Ge, Ti, Zr, Hf, Ta, V, Nb, Cr, Mo, W and Zn; X is at least one element selected from the group consisting of B, C, P, S, C, N and H; and the atomic ratios of a, b, c, d, e fall within the ranges of: $a+b+c+d+e=100$; $1\leqq a\leqq 60$; $1\leqq b\leqq 90$; $0<c\leqq 50$; $0\leqq d\leqq 10$; $0\leqq e\leqq 30$.

In the above general formula, it is preferred that M is Cu, and b falls within the range of 30 to 90.

In the alloy represented by each of general formulas [I] and [II], the selected elements are combined to form a phase having a predetermined composition of a, b, c, d and e and having a desired low melting point or to form a phase capable of reaction at a temperature lower than the melting temperature of the principal phase. Incidentally, the oxygen content should desirably be low.

It is possible for the permanent magnet of the present invention to contain compounds such as oxides, nitrides and carbides, which are based on the element X.

It is also possible to employ a hot working for manufacturing the permanent magnet of the present invention. The method of preparing the matrix alloy is not particularly limited in the present invention. However, it is desirable to employ the ordinary melting method or rapid cooling method. The hot working conditions are not particularly limited in the present invention. However, it is desirable to carry out the hot working at 650 to 1200° C. for 1 minute to 10 hours under the pressing pressure of 0.2 to 20 Ton/cm$^2$. It is also desirable to carry out the hot working under an inert gas atmosphere such as an Ar gas atmosphere or a He gas atmosphere.

The technical idea of the present invention can also be applied to an anisotropic bond magnet using an anisotropic pulverized powder or an isotropic bond magnet using an isotropic pulverized powder. In this case, the bond magnet is prepared by adding a binder made of a resin such as an epoxy resin to a magnetic material powder, followed by molding the mixture. On the other hand, the metal bond magnet is prepared by adding a metal element such as Zn, Al or Cu, which has a melting point lower than that of the hard magnetic phase, or a compound of a rare earth element such as R-Al, R-Ga or R-Cu (R representing a rare earth element (including Y)) to the hard magnetic phase together with a sintering aid, followed by performing the sintering and the molding. It is possible to permit the magnetic field to be oriented in the molding step.

Further, it is possible to adjust the coercive force and the saturation magnetic flux density over a wide range by adjusting the Sm amount and the Cu amount in the alloy composition and by changing the volume ratio of the non-magnetic Cu-rich phase in the sintered body. In this fashion, the permanent magnet of the present invention can be used in various fields.

Various Examples of the present invention will now be described so as to describe more in detail the effects produced by the present invention.

EXAMPLE 1

High purity raw materials of Sm, Zr, Fe, Co, Cu and Si were subjected to an arc melting under an Ar gas atmosphere so as to prepare an ingot having a composition of $(Sm_{0.8}Zr_{0.2})(Fe_{0.83}Co_{0.1}Cu_{0.07})_{9.5}Si_{1.0}$. A homogenizing heat treatment was applied to the ingot thus prepared at 1280° C. for 10 hours under an Ar gas atmosphere, followed by roughly pulverizing the ingot and, then, finely pulverizing the ingot to have an average particle diameter of 3 $\mu$m. The fine powdery material thus prepared was left to stand for 10 hours under an Ar gas atmosphere having an oxygen partial pressure of 0.1 kPa.

Then, a molding was prepared by applying a pressure of 1.5 Ton/cm$^2$ under an magnetic field of 2 T. The molding thus prepared was sintered at 1220° C. for one hour under an Ar gas atmosphere of one atm., followed by cooling the sintered body to room temperature. Further, an aging treatment was performed at 950° C. for 3 hours. The sintered body thus prepared was found to exhibit a residual magnetic flux density of 1.30 T and a coercive force of 10.9 kOe.

The sintered body thus obtained was evaluated by a powder X-ray diffractometry so as to obtain a diffraction pattern reflecting the ThMn12 type crystal structure except weak minor peaks. The alloy microstructure was also examined by SEM-WDX and EPMA. To be more specific, the alloy microstructure observation was performed for 10 view fields in respect of the alloy phase containing Sm and Cu as main components, and the volume ratio of the alloy phase was obtained from the area ratio. As a result, the volume ratio of the alloy phase was found to be 5.1%. Also, the Sm amount and the Cu amount of all the elements of the alloy phase except oxygen were found to be about 21 atomic % (Sm), 69 atomic % (Cu), and 10 atomic % (FeCoSi), respectively.

EXAMPLES 2 to 5

High purity raw materials of Sm, Zr, Fe, Co, Cu, Ga, Si, B, Ti and Sn were subjected to an arc melting under an Ar gas atmosphere so as to prepare ingots. The compositions of these ingots were found to be as follows:

Example 2:

$(Sm_{0.85}Zr_{0.15})\ (Fe_{0.0}Co_{0.1})_{0.91}Cu_{0.06}Ga_{0.03})_{8.63}Si_{1.65}$

Example 3:

$(Sm_{0.85}Zr_{0.15})(Fe_{0.9}Co_{0.1})_{0.91}Cu_{0.06}Ga_{0.03})_{8.93}Si_{1.65}B_{0.2}$

Example 4:

$Sm(Fe_{0.93}Cu_{0.07})_{9.0}Ti_{0.7}$

Example 5:

$(Sm_{0.75}Zr_{0.25})((Fe_{0.8}Co_{0.2})_{0.95}Sn_{0.05})_{8.5}Si_{1.6}$

A homogenizing heat treatment was applied to the ingot thus prepared at 1220 to 1280° C. for 5 hours under an Ar gas atmosphere, followed by roughly pulverizing the ingot and, then, finely pulverizing the ingot to have an average particle diameter of 3 $\mu$m. The fine powdery material thus prepared was left to stand for 10 hours under an Ar gas atmosphere having an oxygen partial pressure of 0.1 kPa.

Then, a molding was prepared by applying a pressure of 1.5 Ton/cm$^2$ under an magnetic field of 2 T. The molding thus prepared was sintered at 1180 to 1220° C. for one hour under an Ar gas atmosphere of one atm., followed by cooling the sintered body to room temperature. Further, an aging treatment was performed at 950° C. for 3 hours. Table 1 shows the magnetic properties of the sintered body thus obtained.

TABLE 1

| Examples | Coercive force (kOe) | Residual magnetic flux density (T) |
|---|---|---|
| 2 | 10.9 | 1.30 |
| 3 | 11.2 | 1.35 |
| 4 | 11.2 | 1.33 |
| 5 | 11.6 | 1.31 |

The sintered body thus obtained was evaluated by a powder X-ray diffractometry so as to obtain a diffraction pattern reflecting the ThMn12 type crystal structure except weak minor peaks. The alloy microstructure was also examined by SEM-WDX and EPMA. To be more specific, the alloy microstructure observation was performed for 10 view fields in respect of each of the alloy phases mainly containing SmCu, SmFeSi and SmSn, respectively, and the volume ratio of the alloy phase was determined from the area ratio. Table 2 shows the results. Incidentally, oxygen is excluded in these analyses. Also, it is possible for these alloy microstructures to contain a small amount of an oxide phase or, in some cases, a small amount of Fe or a R2Fe17 phase (Th2Ni17 phase, Th2Zn17 phase).

Also, the amounts of all the elements of the $SmCu_4$ phase except oxygen were found to be 21 atomic % (Sm), 5 to 15 atomic % (FeCoSi) and 74 to 64 atomic % (Cu), respectively. Further, the amounts of all the elements of the SmFeSi phase ($SmFe_2Si_2$) except oxygen were found to be 19.5 atomic % (Sm), 40 atomic % (FeCo), and 40 atomic % (Si), respectively. Still further, the amounts of all the elements of the SmCu phase except oxygen were found to be 46 atomic % (Sm), 48 atomic % (Cu) and 6 atomic % (FeTi), respectively.

TABLE 2

| | Metal texture |
|---|---|
| Example 2 | Principal phase + $SmCu_4$ phase (5%) + $SmFe_2Si_2$ phase (3%) |
| Example 3 | Principal phase + $SmCu_4$ phase (4%) + $SmFe_2Si_2$ phase (3%) |
| Example 4 | Principal phase + SmCu phase (7%) |
| Example 5 | Principal phase + SmSn phase (6%) |

EXAMPLE 6

High purity raw materials of Sm, Zr, Fe, Co, Cu, Ga, Si and B were subjected to an arc melting under an Ar gas atmosphere so as to prepare an ingot having a composition: $(Sm_{0.8}Zr_{0.2})((Fe_{0.9}Co_{0.1})_{0.95}Cu_{0.04}Ga_{0.01})_{9.6}Si_{1.0}B_{0.2}$.

The ingot thus prepared was rapidly cooled by a single roll method (CuCr roll) at a peripheral speed of 40 m/sec under an Ar gas atmosphere, followed by a heat treatment at 800° C. for 30 minutes so as to obtain a sample for hot press. The hot press was performed at 850° C. for 3 minutes, followed by a die upset at 950° C. for 2 minutes. The resultant hot-pressed material was found to exhibit a residual magnetic flux density of 0.7 T and a coercive force of 15 kOe. Also, the material after the die upset was found to exhibit a residual magnetic flux density of 1.25 T and a coercive force of 10.7 kOe.

The bulk material was evaluated by a powder X-ray diffractometry so as to obtain a diffraction pattern reflecting the ThMn12 type crystal structure except weak minor peaks. The alloy microstructure was also examined by SEM-WDX and EPMA. To be more specific, the alloy microstructure observation was performed for 10 view fields in respect of the alloy phase mainly containing Sm and Cu, and the volume ratio of the alloy phase was determined from the area ratio. As a result, the Sm amount, the Cu amount and the Fe amount of all the elements of the alloy phase except oxygen were found to be 23% (Sm), 62% (Cu) and 15% (FeCoSi), respectively. Also, the volume ratio was found to be 2%. Further, the phase consisting of $SmFe_2Si_2$ was found to consist of 20% of Sm, 42% of FeCo and 38% of Si. The volume ratio was found to be 1%.

Also, a TEM observation was performed to examine the particle diameter of the principal phase. The crystal grain diameters were found to be distributed over a range of between 10 nm and 500 nm, supporting that the grain growth was suppressed even under high temperatures and high pressures.

Incidentally, the rapidly cooled sample was subjected to a heat treatment at 800° C. for one hour, followed by kneading the sample together with 2% by weight of an epoxy series resin. Then, a magnetic molding was applied, followed by curing the molding at 180° C. for 2 hours so as to obtain a resin bond magnet. The resin bond magnet thus prepared was found to exhibit 9 MG Oe of (BH)max, 7 kG of Br, and 15 kOe of Hc.

EXAMPLES 7 to 15

High purity raw materials of Sm, Ce, Pr, Nd, Gd, Tb, Dy, Ho, Er, Y, Zr, Hf, Sc, Fe, Co, Cu, Al, Ga, Mg, Bi and Si were subjected to an arc melting under an Ar gas atmosphere so as to prepared 9 kinds of ingots. Each of the ingots thus prepared was subjected to a homogenizing heat treatment for 10 hours at 1200 to 1300° C. under an Ar gas atmosphere, followed by roughly pulverizing the homogenized ingot. Then, the ingot was finely pulverized to have an average particle diameter of 3 $\mu$m and, then, left to stand for 10 hours under an Ar gas atmosphere having an oxygen partial pressure of 0.1 kPa.

In the next step, a molding was prepared under a pressure of 1.5 Ton/$cm^2$ within a magnetic field of 2 T. The molding thus prepared was sintered at 1180 to 1240° C. for one hour under an Ar gas atmosphere of one atm. Then, the sintered molding was cooled to room temperature, followed by applying an aging treatment to the molding at 700 to 1150° C. for 1 to 50 hours.

The sample thus prepared was evaluated by the method similar to that employed in Example 1. Table 3 shows the results. Incidentally, it has been found by the X-ray diffractometry that any of the samples contained the ThMn12 type crystal structure as the principal phase. Also, the SEM and EDX evaluations have indicated that the sample contained 3 to 6% of a phase having a low melting point.

TABLE 3

| | Composition | Residual magnetic flux density (kG) | Coercive force of (kOe) | Volume percent of metal phase containing R and M2 as main components (%) |
|---|---|---|---|---|
| Example 7 | $(Sm_{0.55}Zr_{0.45})(Fe_{0.76}Co_{0.2}Cu_{0.04})_{9.4}Si_{1.1}$ | 12.9 | 11.8 | 4.1 |
| Example 8 | $(Sm_{0.65}Nd_{0.05}Gd_{0.05}Zr_{0.25})(Fe_{0.60}Co_{0.03}Cu_{0.10})_{9.7}Si_{0.9}$ | 12.8 | 9.8 | 5.5 |
| Example 9 | $(Sm_{0.8}Zr_{0.1}Hf_{0.1})(Fe_{0.78}Co_{0.15}Bi_{0.07})_{10.0}Ti_{0.5}Si_{0.5}$ | 13.0 | 11.6 | 3.9 |
| Example 10 | $(Sm_{0.7}Ce_{0.03}Y_{0.02}Zr_{0.25})(Fe_{0.82}Co_{0.08}Cu_{0.07}B_{0.03})_{9.5}Si_{0.8}Nb_{0.2}$ | 12.8 | 12.5 | 4.7 |
| Example 11 | $(Sm_{0.6}Pr_{0.05}Zr_{0.35})(Fe_{0.73}Co_{0.15}Cu_{0.08}Mg_{0.02}Ga_{0.02})_{9.5}Si_{0.9}Cr_{0.1}$ | 12.7 | 12.8 | 4.3 |
| Example 12 | $(Sm_{0.6}Dy_{0.05}Zr_{0.35})(Fe_{0.85}Co_{0.07}Cu_{0.07}Mg_{0.01})_{9.7}Si_{1.0}$ | 12.4 | 13.0 | 5.5 |
| Example 13 | $(Sm_{0.65}Tb_{0.05}Zr_{0.3})(Fe_{0.88}Co_{0.10}Cu_{0.05}Ag_{0.01}Sn_{0.01})_{9.8}Si_{0.9}V_{0.1}$ | 12.2 | 13.0 | 3.8 |
| Example 14 | $(Sm_{0.55}Er_{0.05}Zr_{0.4})(Fe_{0.75}Co_{0.17}Cu_{0.06}Al_{0.02})_{9.5}Si_{0.9}W_{0.1}$ | 13.1 | 9.9 | 4.3 |
| Example 15 | $(Sm_{0.78}Ho_{0.02}Zr_{0.2}(Fe_{0.80}Co_{0.14}Cu_{0.04}Mn_{0.02})_{9.5}Si_{0.9}Mo_{0.1}$ | 13.0 | 11.0 | 4.6 |

EXAMPLE 16

High purity raw materials of Nd, Y, Zr, Fe, Co, Cu, Si and C were subjected to an arc melting under an Ar gas atmosphere so as to obtain an ingot. The ingot thus prepared was found to comprise 6.6 atomic % of Nd, 2 atomic % of Y, 0.2 atomic % of Zr, 5.2 atomic % of Co, 4 atomic % of Cu, 16.1 atomic % of Si, 8 atomic % of C, and the balance of Fe.

The ingot thus prepared was subjected to a homogenizing heat treatment at 1230° C. for 10 hours under an Ar gas atmosphere, followed by roughly pulverizing the homogenized ingot. Further, the ingot was finely pulverized to have an average particle diameter of 3 μm, and the finely pulverized ingot was left to stand for 10 hours under an Ar gas atmosphere having an oxygen partial pressure of 0.1 kPa. Then, a molding was prepared under a pressure of 1.5 Ton/cm$^2$ under a magnetic field of 2 T. The molding thus prepared was sintered at 1210° C. for one hour under an Ar gas atmosphere of one atm. Then, the sintered molding was cooled to room temperature, followed by applying an aging treatment to the molding at 900° C. for 5 hours. The sintered body thus obtained was found to exhibit a residual magnetic flux density 12.7 kG and a coercive force of 11.0 kOe.

The sintered body thus obtained was evaluated by a powder X-ray diffractometry so as to obtain a diffraction pattern reflecting the ThMn12 type crystal structure except weak minor peaks. The microstructure was also examined by SEM-WDX and EPMA. To be more specific, the microstructure observation was performed for 10 view fields in respect of the alloy phase containing Nd and Cu as main components, and the volume ratio of the alloy phase was determined from the area ratio. As a result, the volume ratio of the alloy phase was found to be 4.1%. Also, the Nd amount and the Cu amount of all the elements of the alloy phase except oxygen were found to be 47 atomic % (NdY), 7 atomic % (FeCoSi) and 48 atomic % (Cu), respectively.

EXAMPLES 17 to 25

High purity raw materials of Sm, Ce, Pr, Nd, Gd, Tb, Dy, Ho, Er, Y, Zr, Hf, Sc, Fe, Co, Cu, Al, Ga, Mg, Bi, C and Si were subjected to an arc melting under an Ar gas atmosphere so as to prepared 9 kinds of ingots. Each of the ingots thus prepared was subjected to a strip casting method under an Ar gas atmosphere so as to obtain a flake-like sample having a thickness of 250 to 350 μm.

The flake-like sample was roughly pulverized, followed by finely pulverizing the sample to have an average particle diameter of 3 μm and, then, left to stand for 10 hours under an Ar gas atmosphere having an oxygen partial pressure of 0.1 kPa.

In the next step, a molding was prepared under a pressure of 1.5 Ton/cm$^2$ within a magnetic field of 2 T. The molding thus prepared was sintered at 1180 to 1250° C. for one hour under an Ar gas atmosphere of one atm. Then, the sintered molding was cooled to room temperature, followed by applying an aging treatment to the molding at 800 to 1150° C. for 1 to 50 hours.

The sample thus prepared was evaluated by the method similar to that employed in Example 1. Table 4 shows the results. Incidentally, it has been found by the X-ray diffractometry that any of the samples contained the ThMn12 type crystal structure as the principal phase. Also, the SEM and EDX evaluations have indicated that the sample contained 3 to 6% of a phase having a low melting point.

TABLE 4

| | Composition | Temperature coefficient of Br | Temperature coefficient of coercive force | Volume percent of metal phase containing R1, R2 and M as main components (%) |
|---|---|---|---|---|
| Example 17 | $(Sm_{0.55}Zr_{0.45})(Fe_{0.76}Co_{0.2}Cu_{0.04})_{9.4}Si_{1.1}Co_{0.2}$ | −0.07 | −0.33 | 5.1 |
| Example 18 | $(Sm_{0.65}Nd_{0.05}Gd_{0.05}Zr_{0.25})(Fe_{0.60}Co_{0.30}Cu_{0.10})_{9.7}Si_{0.9}C_{0.2}$ | −0.07 | −0.33 | 3.9 |
| Example 19 | $(Sm_{0.8}Zr_{0.1}Hf_{0.1})(Fe_{0.78}Co_{0.15}Bi_{0.07})_{10.0}Ti_{0.5}Si_{0.5}N_{0.4}H_{0.05}$ | −0.07 | −0.33 | 3.5 |
| Example 20 | $(Sm_{0.7}Ce_{0.03}Y_{0.02}Zr_{0.25})(Fe_{0.82}Co_{0.08}Cu_{0.07}B_{0.03})_{9.5}Si_{0.8}Nb_{0.2}C_{0.3}$ | −0.07 | −0.33 | 4.7 |
| Example 21 | $(Sm_{0.6}Pr_{0.05}Zr_{0.35})(Fe_{0.73}Co_{0.15}Cu_{0.08}Mg_{0.02}Ga_{0.02})_{9.5}Si_{0.9}Cr_{0.1}C_{0.4}$ | −0.07 | −0.33 | 4.7 |
| Example 22 | $(Sm_{0.6}Dy_{0.05}Zr_{0.35})(Fe_{0.85}Co_{0.07}Cu_{0.07}Mg_{0.01})_{9.7}Si_{1.0}N_{0.6}H_{0.3}$ | −0.07 | −0.33 | 4.3 |
| Example 23 | $(Sm_{0.65}Tb_{0.05}Zr_{0.3})Fe_{0.88}Co_{0.10}Cu_{0.05}Ag_{0.01}Sn_{0.01})_{9.8}Si_{0.9}V_{0.1}N_{0.5}H_{0.05}$ | −0.07 | −0.33 | 4.9 |
| Example 24 | $(Sm_{0.55}Er_{0.05}Zr_{0.4})(Fe_{0.75}Co_{0.17}Cu_{0.06}Al_{0.02})_{9.5}Si_{0.09}W_{0.1}C_{0.7}$ | −0.07 | −0.33 | 5.1 |
| Example 25 | $(Sm_{0.78}Ho_{0.02}Zr_{0.2})(Fe_{0.80}Co_{0.14}Cu_{0.04}Mn_{0.02})_{9.5}Si_{0.9}Mo_{0.1}N_{0.8}H_{0.1}$ | −0.07 | −0.33 | 4.3 |

EXAMPLE 26

The sample prepared in Example 16 was subjected to a heat treatment at 440° C. for 4 hours under a mixed gas of ammonia and hydrogen. The resultant sintered body was found to exhibit a residual magnetic flux density of 12.5 kG and a coercive force of 7.5 kOe.

The sintered body thus obtained was evaluated by a powder X-ray diffractometry so as to obtain a diffraction pattern reflecting the ThMn12 type crystal structure except weak minor peaks. The microstructure was also examined by SEM-WDX and EPMA. To be more specific, the microstructure observation was performed for 10 view fields in respect of the alloy phase containing Nd and Cu as main components, and the volume ratio of the alloy phase was determined from the area ratio. As a result, the volume ratio of the alloy phase was found to be 4.1%. Also, the Nd amount and the Cu amount of all the elements of the alloy phase except oxygen were found to be about 48 atomic % (Nd), 49 atomic % (Cu), and 3 atomic % (FeCoSi), respectively. Further, the sample was found to have a composition of $(Nd_{0.85}Y_{0.05}Zr_{0.1})(Fe_{0.79}Co_{0.15}Cu_{0.06})_{9.8}Si_{1.0}C_{0.6}N_{0.3}H_{0.02}$.

As described above in detail, the present invention permits improving the saturation magnetization and the coercive force of a permanent magnet, compared with the conventional permanent magnet. In addition, the present invention makes it possible to provide a permanent magnet exhibiting improved temperature characteristics of the coercive force. As a result, the present invention produces prominent effects in the field of application of various permanent magnets. For example, the permanent magnet of the present invention makes it possible to miniaturize an electrical appliance and to save the energy. What should also be noted is that, since the permanent magnet of the present invention is formed of a magnetic material exhibiting improved temperature characteristics, the permanent magnet can be used under an environment of high temperatures.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A permanent magnet which comprises an alloy comprising a hard magnetic phase having a $ThMn_{12}$ tetragonal structure and a nonmagnetic phase, wherein said alloy is represented by a general formula given below:

$$[R_{1-a}(M1)_a][T_{1-b-c}(M2)_b(M3)_c]_dX_\alpha$$

where R is at least one rare earth element (including Y); M1 is at least one element selected from the group consisting of Zr and Hf; T is at least one element selected from the group consisting of Fe, Co, and Ni; M2 is Cu or a combination of Cu and at least one element selected from the group consisting of Bi, Sn, Mg, In, and Pb; M3 is at least one element selected from the group consisting of Al, Ga, Ge, Zn, B, P and S; x is at least one element selected from the group consisting of Si, Ti, V, Cr, Mn, Nb, Mo, Ta and W; and the atomic ratios of a, b, c, d, and $\alpha$ fall within the ranges of: $0 \leqq a \leqq 0.6$; $0.01 \leqq b \leqq 0.20$; $0 \leqq c \leqq 0.05$, $6 \leqq d \leqq 11$, and $0.5 \leqq \alpha \leqq 2.0$.

2. The permanent magnet according to claim 1, wherein said nonmagnetic phase has a melting point lower than that of the hard magnetic phase having a $ThMn_{12}$ tetragonal structure.

3. The permanent magnet according to claim 1, wherein said permanent magnet comprises 0.1 to 20% by volume of said nonmagnetic phase.

4. The permanent magnet according to claim 1, wherein said the nonmagnetic phase is represented by the general formula given below:

$$R_aM_bT_cX_dO_e$$

where R is at least one rare earth element (including Y); M is Cu or a combination of Cu and at least one element selected from the group consisting of Bi, Sn, Mg, Pd and In; T is at least one element selected from Si, Fe, Co, Ni, Mn, Al, Ga, Ge, Ti, Zr, Hf, Ta, V, Nb, Cr, Mo, W and Zn; X is at least one element selected from the group consisting of B, C, P and S; and the atomic ratios of a, b, c, d, e fall within the ranges of: $a+b+c+d+e=100$; $1 \leqq a \leqq 60$; $1 \leqq b \leqq 90$; $0 \leqq c \leqq 50$; $0 \leqq d \leqq 10$; $0 \leqq e \leqq 30$.

5. The permanent magnet according to claim 4, wherein M is Cu, and b falls within the range of 30 to 90.

6. The permanent magnet according to claim 1, wherein said permanent magnet comprises an oxide phase comprising as main component a rare earth element (including Y) and oxygen.

7. The permanent magnet according to claim 1, wherein said permanent magnet is in the form of a sintered body.

8. A permanent magnet which comprises an alloy comprising a hard magnetic phase having a $ThMn_{12}$ tetragonal structure and a nonmagnetic phase, wherein said alloy is represented by a general formula given below:

$$[R_{1-a}(M1)_a][T_{1-b-c}(M2)_b(M3)_c]_dx_\alpha A\beta$$

where R is at least one rare earth element (including Y); M1 is at least one element selected from the group consisting of Zr and Hf; T is at least one element selected from the group consisting of Fe, Co and Ni; M2 is Cu or a combination of Cu and at least one element selected from the group consisting of Bi, Sn, Mg, In and Pb; M3 is at least one element selected from the group consisting of Al, Ga, Ge, Zn, B, P and S; x is at least one element selected from the group consisting of Si, Ti, V, Cr, Mn, Nb, Mo, Ta and W; A is at least one element selected from the group consisting of N, C and H; and the atomic ratios of a, b, c, d and $\alpha$ fall within the ranges of: $0 \leqq a \leqq 0.6$; $0.01 \leqq b \leqq 0.20$; $0 \leqq c \leqq 0.05$; $6 \leqq d \leqq 11$; $0.5 \leqq \alpha \leqq 2.0$; and $0 \leqq \beta \leqq 2.0$.

9. The permanent magnet according to claim 8, wherein said nonmagnetic phase has a melting point lower than that of the hard magnetic phase having a $ThMn_{12}$ tetragonal structure.

10. The permanent magnet according to claim 8, wherein said permanent magnet contains 0.1 to 20% by volume of said nonmagnetic phase.

11. The permanent magnet according to claim 8, wherein said nonmagnetic phase is represented by a general formula given below:

$$R_aM_bT_cX_dO_e$$

where R is at least one rare earth element (including Y); M is Cu or a combination of Cu and at least one element selected from the group consisting of Bi, Sn, Mg, Pd and In; T is at least one element selected from the group consisting of Si, Fe, Co, Ni, Mn, Al, Ga, Ge, Ti, Zr, Hf, Ta, V, Nb, Cr, Mo, W and Zn; X is at least one element selected from the group consisting of B, C, P, S, C, N and H; and the atomic ratios of a, b, c, d, e fall within the ranges of: $a+b+c+d+e+=100$; $1 \leqq a \leqq 60$; $1 \leqq b \leqq 90$; $0 \leqq c \leqq 50$; $0 \leqq d \leqq 10$; $0 \leqq e \leqq 30$.

12. The permanent magnet according to claim 11, wherein M is Cu, and b falls within the range of 30 to 90.

13. The permanent magnet according to claim 8, wherein said permanent magnet comprises an oxide phase comprising as main component a rare earth element (including Y) and oxygen.

14. The permanent magnet according to claim 8, wherein said permanent magnet is in the form of a sintered body.

15. The permanent magnet according to claim 8, wherein said permanent magnet has a thickness of 50 $\mu$m to 1 mm.

* * * * *